United States Patent [19]

Crepinsek

[11] Patent Number: 4,576,023

[45] Date of Patent: Mar. 18, 1986

[54] DOOR STILE LOCK AND LATCH BOLT ASSEMBLY

[76] Inventor: Alois Crepinsek, 97 N. Arizona Pl., Chandler, Ariz.

[21] Appl. No.: 532,918

[22] Filed: Sep. 16, 1983

[51] Int. Cl.[4] ..... E05B 65/06; E05B 9/08

[52] U.S. Cl. ..... 70/137; 70/139; 70/417; 70/451

[58] Field of Search ..... 70/137, 139, 379 R, 70/380, 99, 100, 123, DIG. 35, DIG. 60, 451, 461; 49/503

[56] References Cited

U.S. PATENT DOCUMENTS

| | | | |
|---|---|---|---|
| 2,151,245 | 3/1939 | Swilens | 70/380 X |
| 2,644,554 | 7/1953 | Katz | 70/451 |
| 2,854,839 | 10/1958 | Eads | 70/139 |
| 3,103,804 | 9/1963 | Wood et al. | 70/139 |
| 3,204,439 | 9/1965 | Eads | 70/451 |
| 3,659,445 | 5/1972 | Eads et al. | 70/451 |
| 3,678,716 | 7/1972 | Cobb | 70/139 X |
| 3,740,979 | 6/1973 | Crepinsek | 70/451 X |
| 3,899,907 | 8/1975 | Prahl | 70/451 X |
| 4,218,903 | 8/1980 | Eads | 70/139 X |

*Primary Examiner*—Robert L. Wolfe

*Assistant Examiner*—Vinh Luong

*Attorney, Agent, or Firm*—Robert A. Hirschfeld; James F. Duffy

[57] ABSTRACT

A door stile lock has a rotary latch bar. The rotary latch bar contains a compression loaded anvil within its interior. The latch bar rotates about the lock cylinder housing. The housing is provided with retention ports for engaging the compression loaded anvil at selected positions to inhibit rotation of the latch bar when the anvil is so engaged. Interior of the cylinder housing is an actuator rotatable by the lock key. The actuator raises the anvil from the retention ports and drives the latch bar about the axis of the cylinder housing between nominal locked and unlocked positions of the latch bar. The compression loaded anvil engages the retention ports in the cylinder housing at both the nominal locked and unlocked positions. A lock body engages the cylinder housing in a non-rotating manner. The lock body is then compressively engaged within the door stile. The compression is provided by means of a screw driven U-shaped compression saddle having limited rotation about the driving screw fastener and the ability to translate along the axis of that screw fastener.

19 Claims, 14 Drawing Figures

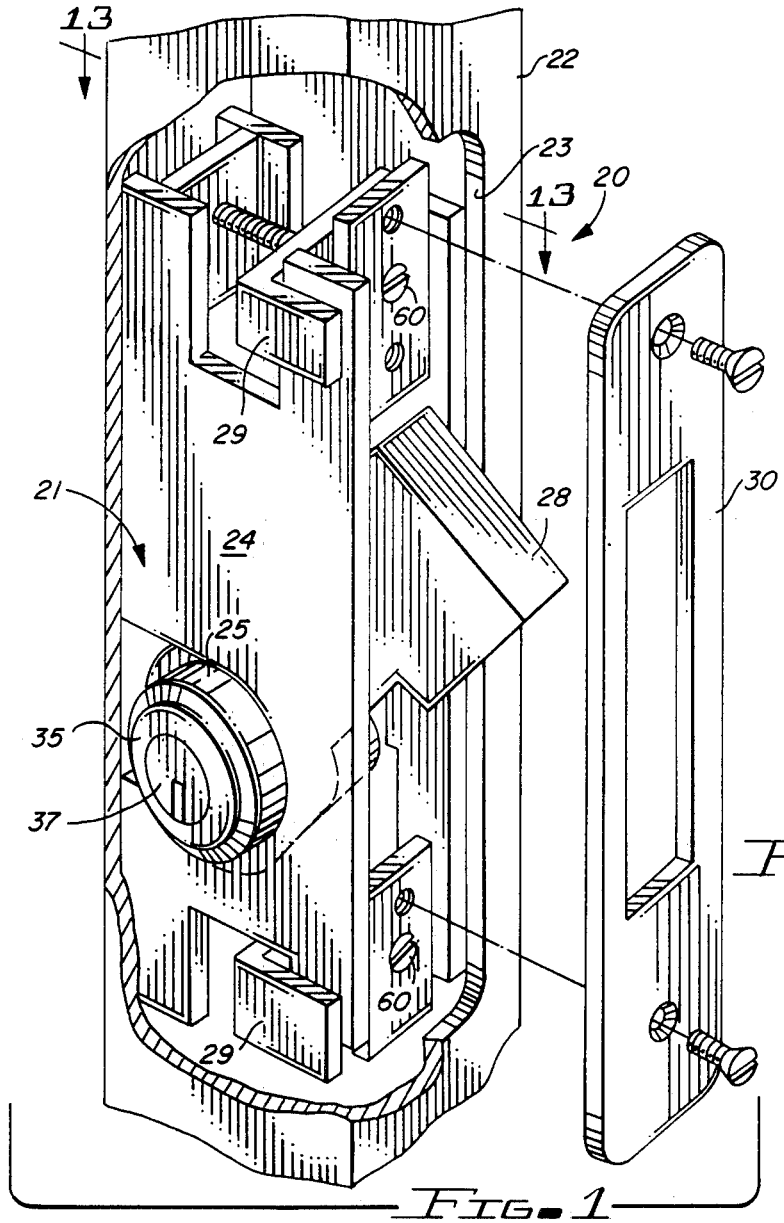
FIG. 1
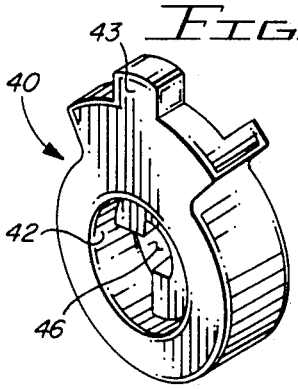
FIG. 4
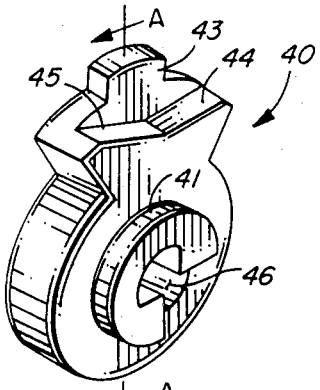
FIG. 5
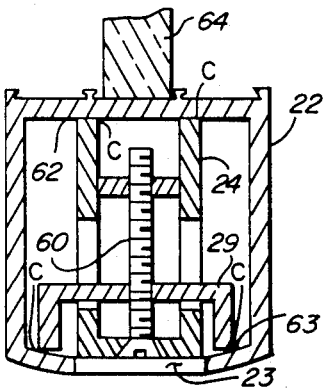
FIG. 13
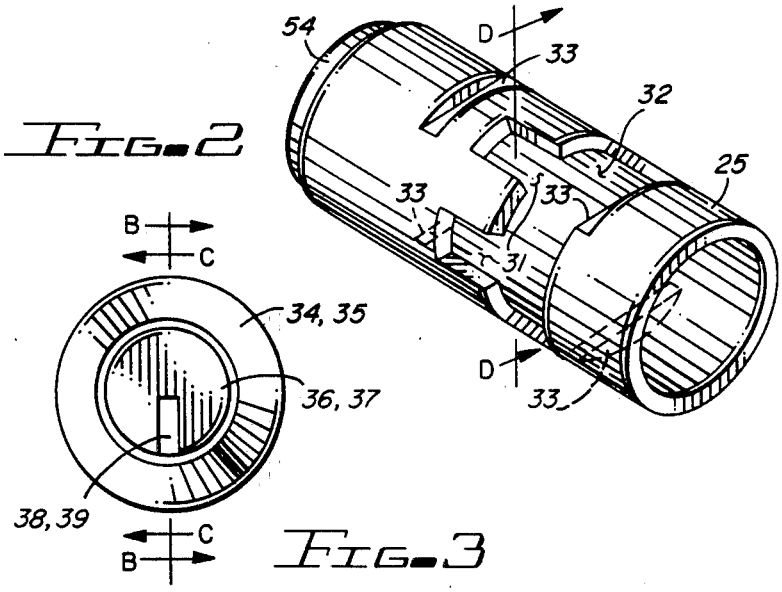
FIG. 2
FIG. 3
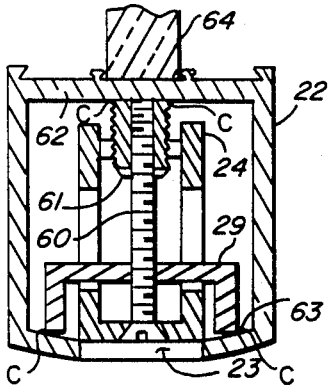
FIG. 14

DOOR STILE LOCK AND LATCH BOLT ASSEMBLY

BACKGROUND OF THE INVENTION

1. Field of the Invention

The invention relates to locks for mounting in the hollow stile of a door.

In particular the invention relates to a door stile lock having improved means for actuating the latch bar of the lock.

In addition the invention relates to a door stile lock in which the lock body is maintained within the hollow stile by compressive means rather than by use of screw fasteners coupling the lock body to the door stile.

2. Related Applications

Part of the disclosure contained herein related to the compressive engagement of a lock body within a hollow door stile is disclosed in the inventor's patent application Ser. No. 532,919 filed Sept. 16, 1983 for ENGAGEMENT OF LOCK BODY WITHIN A HOLLOW DOOR-STILE filed coincidentally herewith.

Prior Art

The inventor herein disclosed a door stile lock and latch bolt assembly in U.S. Pat. No. 3,740,979 issued June 26, 1973. That disclosure taught the modification of the interior of a hollow door stile to provide means for engagement with latching devices carried internal of the latch bar of the lock. Because of the complexity of the spring loaded latching lever arrangements carried by the latch bar and because of the need to modify the hollow door stile the manufacture of the lock of the earlier invention was not cost effective.

Further, the lock body of the earlier lock was maintained in position within the hollow door stile by means of screw fasteners which were threaded into bores at the rear surface of the hollow stile. Because the hollow stile is generally thin-walled, relatively, this arrangement lacked the strength that would be desired of a security device. Further, the driving of a screw fastener through the threaded bore occasionally brought the screw into contact with a glass panel supported by the door frame. Occasionally, this caused damage to that glass panel.

It is an object of the invention to overcome the deficiencies of the earlier described lock.

It is a further objective of the invention to provide the means for retaining the latch bar of the lock in fixed positions without recourse to modification of the interior of the door stile.

It is a further objective of the invention to provide latch bar retention means on the lock cylinder housing to retain the latch bar in fixed positions.

It is another objective of the invention to provide actuating means within the lock cylinder housing for releasing the latch bar from engagement with the retention means and for driving the latch bar about the axis of the lock cylinder housing.

An additional objective of the invention is to provide compressive means for retaining the lock body within the hollow stile without recourse of threaded screw fasteners to couple the lock body to the stile.

SUMMARY OF THE INVENTION

The invention is an improvement in a lock which is mounted in a hollow door-stile, the lock having a lock body engagedly supporting a cylinder and keyway block housing, the housing in turn engaging a latch bar for rotation about the housing and further including a first lock cylinder and keyway block assembly within that housing. The improvement comprises a compression loaded anvil slidingly disposed within the latch bar. The anvil is slidingly directed by compression loading toward the axis of the cylinder and keyway block housing when the latch bar is rotatingly engaged about that housing. Included also are retention means which are formed in the surface of the housing for lockingly engaging the anvil to prevent rotation of the latch bar about the housing when the anvil is so lockingly engaged.

The improved lock further comprises actuator means which are rotatable about the axis of the housing with the keyway block when a key is inserted within the block to engage the actuator means. The actuator means itself comprises a first portion within the housing for raising the anvil from the retention means so as to free the latch bar for rotation about the housing. A second portion of the actuator means extends outside the housing and engages with the latch bar for driving the latch bar rotatingly about the housing when the anvil has been so raised from the retention means.

In a presently preferred embodiment of the invention, the improved lock contains a second lock cylinder and keyway block assembly carried by the housing. In this instance, the actuator means is emplaced within the housing between the first and second lock cylinder and keyway block assemblies. The actuator is rotatable about the axis of said housing when a key is inserted within either keyway block of either the first or the second cylinder and block assembly.

The invention also includes means for engaging the lock body within the interior of a hollow tubular structural member of a door such as a door stile, after the lock body has been passed freely to the interior of that structural member through an opening in that member provided for passage of the lock therethrough. The engagement means comprises screw actuated compression means, screw-threadedly coupled to said lock body for rotation about the axis of a screw actuating the compression means and for translation along the same axis.

Stop means are coupled to the lock body for selectedly limiting the rotation of the screw actuated compression means to at least one of two rotative positions. One position permits ease of passage of the lock body through the opening in the door stile while the screw actuated compression means is coupled to and inplaced on the lock body. The second position permits compressive engagement of the compression means with the interior of the door stile as the compression means is screw actuated.

The lock body is provided with surface contact means for bearing against a first interior surface of the door stile when the screw actuated compression means is actuated into compressive contact with a second interior surface of that door stile. These surface contact means may comprise screw adjustable extensions of the lock body, adjustable for adapting said lock body for installation within door stiles of various interior dimensions. In a presently preferred embodiment the screw actuated compression means comprises a U-shaped compression saddle coupled to the lock body by a screw-threaded fastener and rotatable about the axis of that screw-threaded fastener until the compression saddle intercepts the stop means on the lock body. The compression saddle is then translatable along the axis of the screw-threaded fastener as the fastener is continued to be rotated about its axis. As before, the lock body comprises surface contact means for bearing against a first interior surface of the door stile when the legs of the U-shaped compression saddle are drawn into compressive contact with the second interior surface of the stile. Again, the surface contact means may comprise screw adjustable extensions of the lock body so as to adapt the lock body for installation within stiles of various interior dimensions.

A word picture of the improved lock would define the invention as comprising a lock cylinder housing, an assembly comprising a lock cylinder and a keyway block emplaced within that housing. A latch bar actuator within the housing is coupled for rotation with the keyway block about the axis of the housing when a key is inserted into the keyway. The latch bar is rotatingly coupled to the housing and further drivingly coupled to the latch bar actuator for rotation about that housing when the actuator is so rotated. A compression loaded anvil is housed within the latch bar and compressively driven toward the axis of the housing. Retention means on the housing lockingly engage the anvil to prevent rotation of the latch bar about the housing. Finally, an anvil actuator, coupled to the latch bar actuator, raises the anvil from engagement with the retention means to permit the latch bar to be driven about the housing by the latch bar actuator when a key is inserted in the keyway. A lock body is non-rotatingly coupled to the housing and compression means are coupled to the lock body to compressively engage the lock body within the hollow stile of a door in which the lock is to be mounted.

DESCRIPTION OF THE DRAWINGS

FIG. 1 is a perspective view of the improved door stile lock housed within a stile and retained there by screw actuated compression means;

FIG. 2 is a perspective view of the lock cylinder housing which houses the lock cylinder and keyway block and illustrates the latch-bar-anvil retention ports and lock body engagement slots;

FIG. 3 is an end elevation view of a lock cylinder and keyway block assembly;

FIGS. 4 and 5 illustrate in left and right side perspective views respectively the latch bar anvil actuator and drive element;

FIGS. 13 and 14 are cross-sectional views of two embodiments of the lock body each compressively engaged within the hollow stile of a door.

DETAILS OF THE INVENTION

Figure 6:
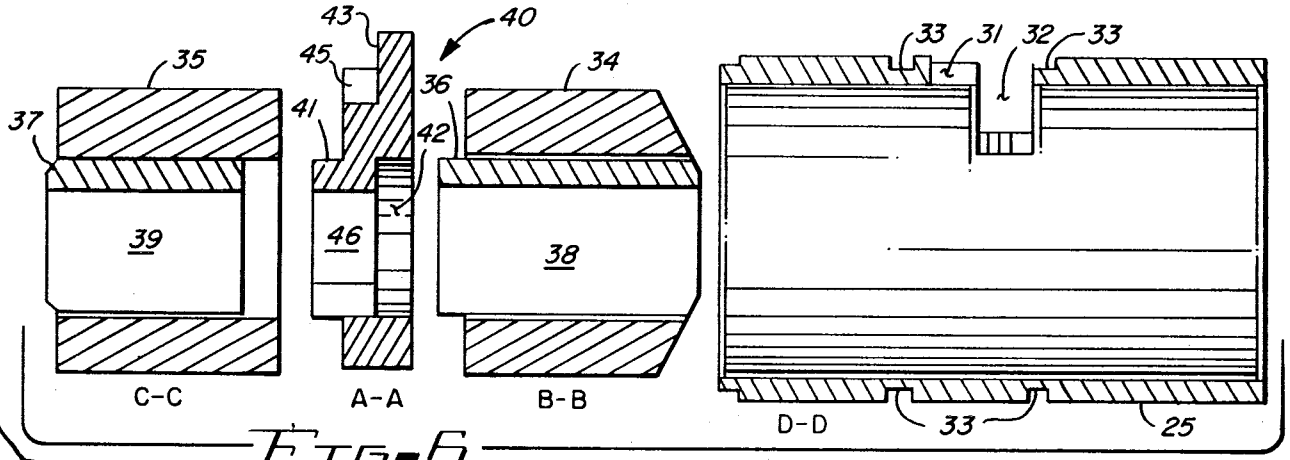
FIG. 6 is a sectional exploded assembly of the elements depicted in FIGS. 2 through 5, wherein section is taken along section line A—A of FIG. 5, section lines B—B and C—C of FIG. 3, and section line D—D of FIG. 2.

For the purpose of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device; and such further applications of the principles of the invention as illustrated herein being contemplated as would normally occur to one skilled in the art to which the invention relates.

FIG. 1 illustrates the assembly 20 of the improved lock 21 mounted within a hollow door-stile 22. The lock is emplaced within stile 22 through opening 23. Lock 21 is comprised of a lock body 24 which engages lock cylinder housing 25. In the view of FIG. 1 lock cylinder housing 25 is seen to contain lock cylinder 35 and keyway block 37. A latch bar 28 is coupled to lock cylinder housing 25 and is rotatable about that housing. Latch bar 28 is illustrated as being partially displaced from lock body 24. Latch bar 28 nominally rests at one of two positions, an upright position with respect to FIG. 1, in which the latch bar 28 is completely enclosed within lock body 24, and a latch position in which latch bar 28 extends horizontally outward from lock body 24 with respect to the illustration of FIG. 1.

Compression means in the form of U-shaped compression saddles 29 are actuated by screw fasteners 60 to compressively engage lock body 24 within the confines of door stile 22. After lock 21 is installed within stile 22 latch plate 30 is screw fastened to lock body 24 to close the stile opening 23 and provide a finished appearance to the installation.

Because the working relationships of the various elements making up the improved lock can best be understood by cross-sectional assembly drawings, certain of these elements will be introduced in association with perspective drawings to better understand the structural nature of the individual elements. Thus, FIG. 2 presents the lock cylinder housing 25 in perspective view. Two cut-outs 31, hereinafter referred to as retention ports 31, will serve to engage a spring loaded anvil within latch bar 28 so that latch bar 28 may be maintained in one of two fixed positions in its rotation about lock cylinder housing 25. A slot 32 adjacent retention ports 31 permits moveable access for a latch bar actuator tang which will engage the latch bar 28 for rotation about housing 25.

So that housing 25 may be maintained in non-rotatable engagement with lock body 24, lock-body-engagement grooves 33 are provided. Grooves 33 engage the edges of an opening provided in lock body 24 for reception of housing 25.

While the embodiment disclosed herein will teach the use of two cylinder and keyway block assemblies as a preferred embodiment, and each of these assemblies will in general have a slightly different cross-sectional configuration, the end view of both of these assemblies is essentially the same as that presented in FIG. 3. The first such assembly comprises a lock cylinder 34 having therein a keyway block 36 which is provided with a keyway 38. The second such assembly is comprised of a lock cylinder 35 having therein a keyway block 37 which contains a keyway 39.

FIGS. 4 and 5 present perspective views of different sides of latch and anvil actuator 40. On the surface of actuator 40 depicted in FIG. 5 is seen a flange 41 which will be later seen to engage within the interior of lock cylinder 35. The surface of actuator 40 depicted in FIG. 4 contains a recess 42 which will engage with the outer diameter of keyway block 36. At the top of actuator 40 depicted in both FIGS. 4 and 5 is an actuator tang 43 which will be lockingly engaged with latch bar 28 to drive latch bar 28 into rotation about housing 25. Seen also in FIG. 5 are two inclined planes 44 and 45 which will be employed to actuate a locking anvil housed within latch bar 28. In both FIGS. 4 and 5 the odd shaped opening 46 provides an impeded keyway which limits the free rotation of a key inserted therein to approximately 90°. Further attempts to rotate the key will result in actuator 40 being rotated about the axis of a key inserted within impeded keyway 46.

FIGS. 2, 3 and 4 are provided with sectional viewing lines A—A, B—B, C—C, and D—D. The cross sections taken along these viewing lines are presented in FIG. 6 which is an exploded view of the assembly of the two lock cylinder keyway block assemblies and the actuator within the housing 25. Proceeding from left to right in FIG. 6 there is depicted first the assembly comprising lock cylinder 35 which carries keyway block 37. A keyway 39 is contained within keyway block 37 to permit access of a key for operating the lock cylinder assembly. Next is seen the cross section of the latch and anvil actuator 40 with latch actuator 43 and anvil actuator inclined plane 45. Flange 41 will mate with the inner diameter of lock cylinder 35. Key cylinder 34 with keyway block 36 and keyway 38 is next in line. Keyway block 36 mates with recess 42 in actuator 40. Note should be made of the fact that no tumbler pins are illustrated in the cross-sectional views B—B, C—C. The tumbler pins have been omitted for clarity but those skilled in the art will be aware of their presence and function.

The three elements just described are inserted within lock cylinder housing 25. In practice, the first element inserted within lock cylinder housing 25 is actuator 40. The diameter of actuator 40 is slightly less than that of either of lock cylinders 34 or 35, and it may be tipped as it enters into lock cylinder housing 25. Tang 43 is then drawn up through slot 32 after which lock cylinder 35 may be inserted from the left and lock cylinder 34 from the right. The lock cylinders may be retained within housing 25 by conventional means such as pinning or by the use of set screws.

Figure 7:
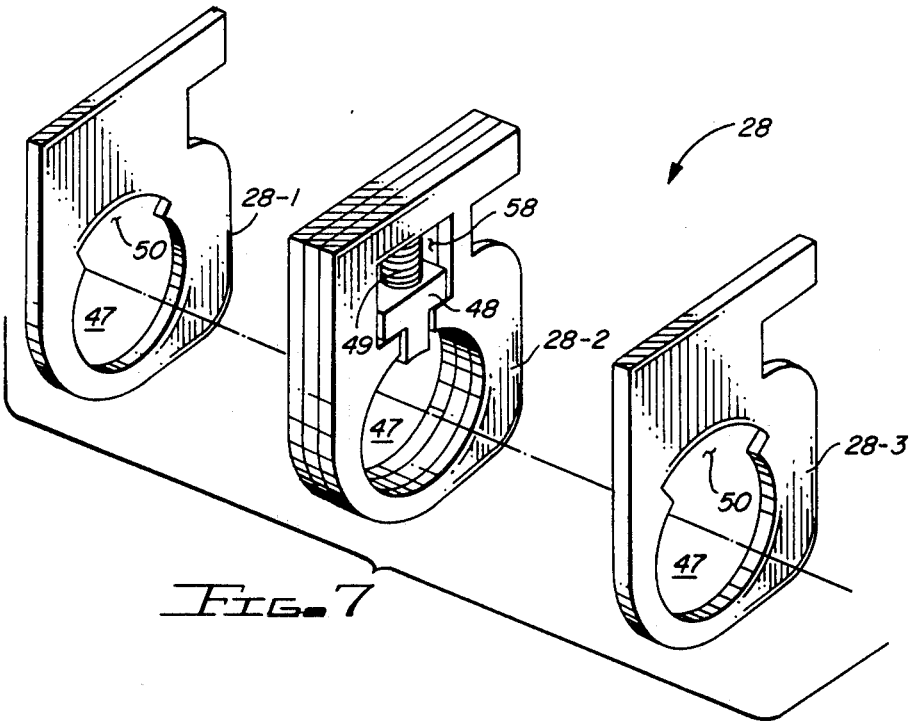
FIG. 7 is an exploded perspective assembly of the latch bar of the improved lock illustrating the compression loaded anvil housed within the latch bar.

FIG. 7 is an exploded perspective view of latch bar 28. As illustrated, latch bar 28 is made up of laminations. The central lamination 28-2 is provided with a recess 58 which houses an anvil 48 and a spring 49 for maintaining a compressive load on anvil 48. When the end laminations 28-1 and 28-3 are joined to the central laminations 28-2, anvil 48 and spring 49 will be housed within the assembled latch bar 28. Latch bar 28 is provided with a central bore 47 to permit the entry of lock cylinder housing 25. Latch bar 28 will rotate about housing 25 except in those instances in which anvil 48 engages the retention ports 31 on the surface of housing 25. In each of the end laminations 28-1 and 28-3 an elongated arcuate recess 50 is provided. Tang 43 of actuator 40 will engage with one of these arcuate openings so that actuator 40 may drive latch bar 28 about housing 25 when tang 43 is rotated into interfering contact with the side of the elongated arcuate opening 50.

Figure 8:
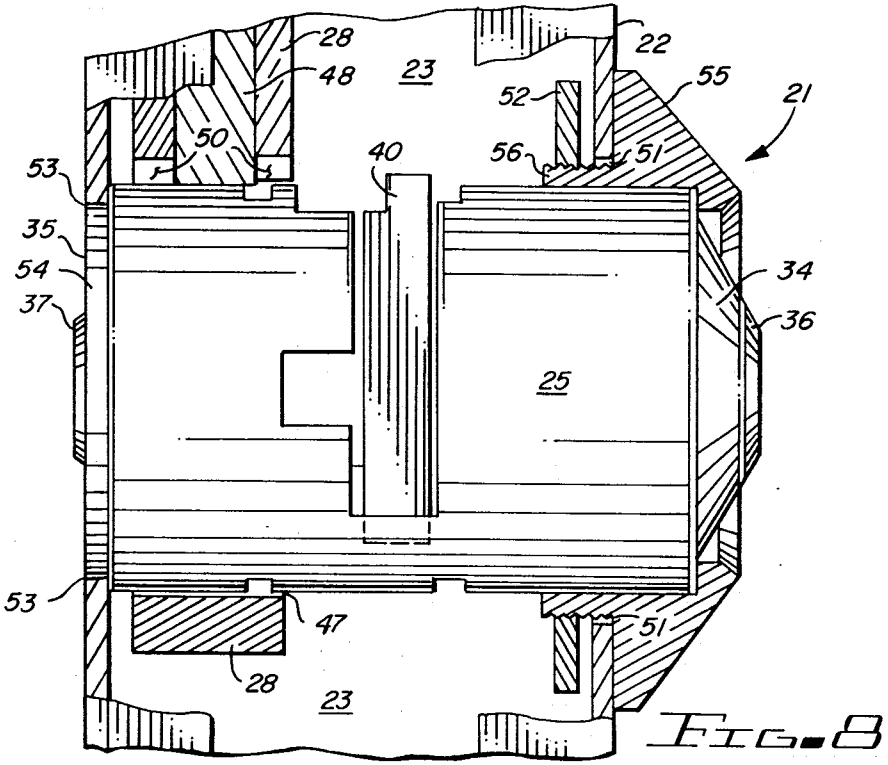
FIG. 8 is a partial sectional drawing provided for purposes of illustrating the steps to be taken in mounting the improved lock within a door stile.

Assuming that the elements set forth in FIG. 6 have been assembled as discussed, the manner in which the lock is mounted in a door stile may be disclosed. Reference should now be made to FIG. 8. Door stile 22 is provided with a circular opening 51 at the inner surface of stile 22, and with a similar-though-smaller diameter opening 53 at the outer surface of stile 22. Cylinder housing 25 with lock cylinders 34 and 35 and actuator 40 emplaced therein is inserted into opening 51 from the right as illustrated in FIG. 8. With the housing partially inserted into stile 22 through opening 51 a bezel lock nut 52 is inserted through opening 23 of stile 22 and emplaced over lock cylinder housing 25. Latch bar 28 is then emplaced within the opening 23 of stile 22 and lock cylinder housing 25 is passed through bore 47 of latch bar 28. To accomplish this finger pressure is applied to anvil 48 to permit the passage of lock cylinder housing 25 through latch bar bore 47. Latch bar 28 is maintained to the left of lock cylinder housing 25 for the moment.

Lock cylinder housing 25 is then advanced completely to the left of the illustration of FIG. 8 so that flange 54 of housing 25 enters the opening 53 in stile 22. This will bring lock cylinder 53 and keyway block 37 in near-flush configuration with the outer surface of stile 22. At this point decorative bezel 55 is passed over the right end of housing 25 so that bezel flange 56 passes through opening 51 of stile 21 and enters the interior of stile 21. Working through opening 23 in stile 22 bezel lock nut 52 is advanced over the threads of bezel flange 56 until it makes contact with the interior wall of stile 22. In this manner, lock cylinder housing 25 is retained within door stile 22 by the interference fit with housing 25 and opening 53 in the door stile 22 and the captivation of the housing 25 by bezel 55 and bezel lock nut 52.

Again working through the opening 23 of door stile 22 latch bar 28 may be advanced toward the center of the lock so that actuator 40 will enter into elongated recess 50 in latch bar 28. As will be later seen, when actuator 40 enters into elongated recess 50 anvil 48 will be driven downward by spring 49 to enter a recess port 31 in housing 25 and come to rest on inclined planes 44 and 45 of actuator 40.

Figure 9:
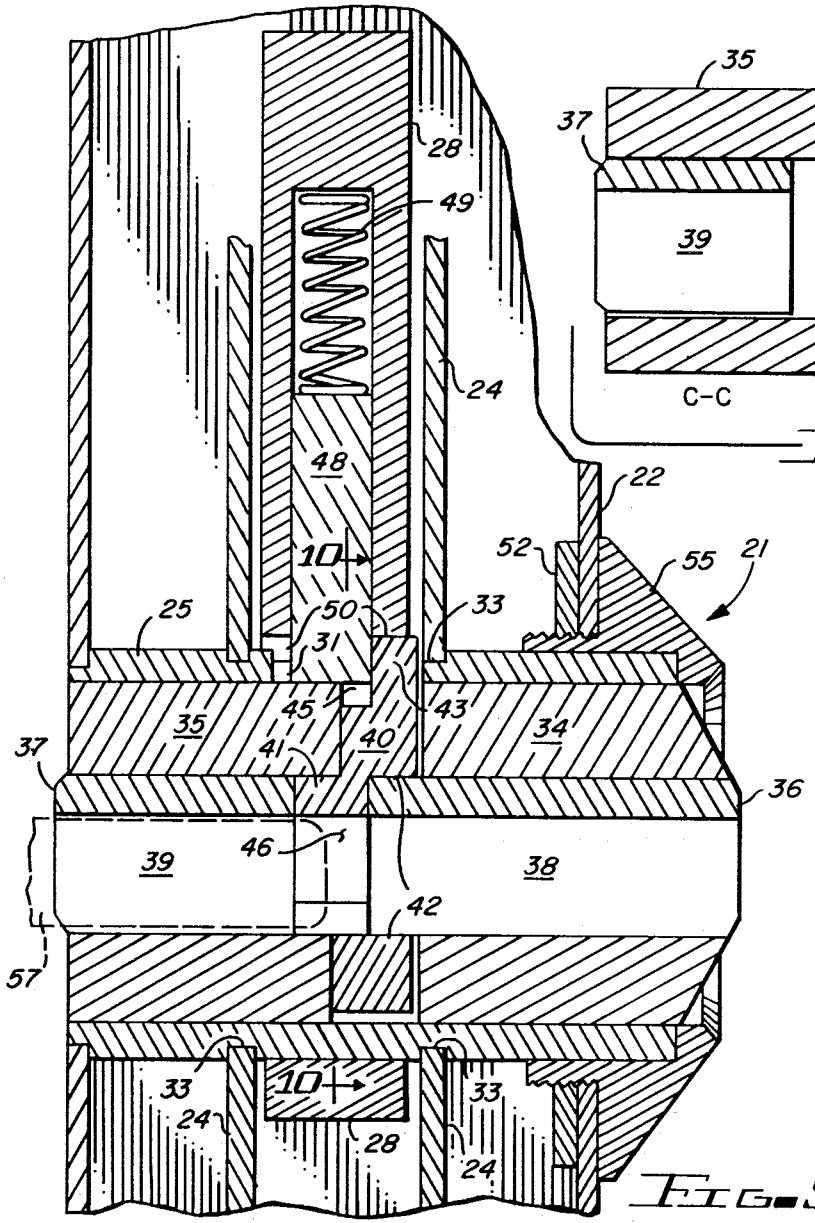
FIG. 9 is a sectional drawing of the improved lock when fully installed within a door stile with lock body in place lockingly engaging the lock cylinder housing.

Assuming that lock cylinder housing 25 has been installed within door stile 22 as just discussed the assembly will assume the configuration illustrated in FIG. 9 in cross-sectional view. In FIG. 9 bezel lock nut 52 has been drawn up into captivating contact with door stile 22. Latch bar 28 has been centered within door stile 22 and anvil 48 has entered retention port 31 of housing 25. The tang 43 of actuator 40 has entered the elongated arcuate recess 50 of latch bar 28. The base of anvil 48 upon entering retention port 31 has come to rest on the inclined plane 45 of actuator 40. Not shown in FIG. 9 is the fact that anvil 48 also rests, as well, on inclined plane 44 of actuator 40.

The interior assembly of lock housing 25 is also clearly illustrated in FIG. 9. The flange 41 of actuator 40 is inserted within lock cylinder 35 while keyway block 36 extends into the recess 42 of actuator 40. It will be noted that there is no mechanism for coupling the rotary motion of either keyway block 37 or keyway block 36 to actuator 40. The necessary rotary coupling is provided upon insertion of a key into either keyway 39 or 38. For illustrative purposes, a key 57 is shown in phantom outline inserted within keyway 39 and extending into the keyway 46 of actuator 40. When key 57 trips the necessary tumblers (not shown) to permit keyway block 37 to rotate within lock cylinder 35, the extension of key 57 into impeded keyway 46 of actuator 40 will permit the rotation of actuator 40 with the rotation of key 57 and keyway block 37. As will be shown, rotation of actuator 40 causes anvil 48 of latch bar 28 to rise up along either one of inclined planes 44 and 45 of actuator 40 bringing tang 43 of actuator into interfering contact with an end of arcuate recess 50 so as to drive latch bar 28 about the axis of housing 25.

Figure 12:
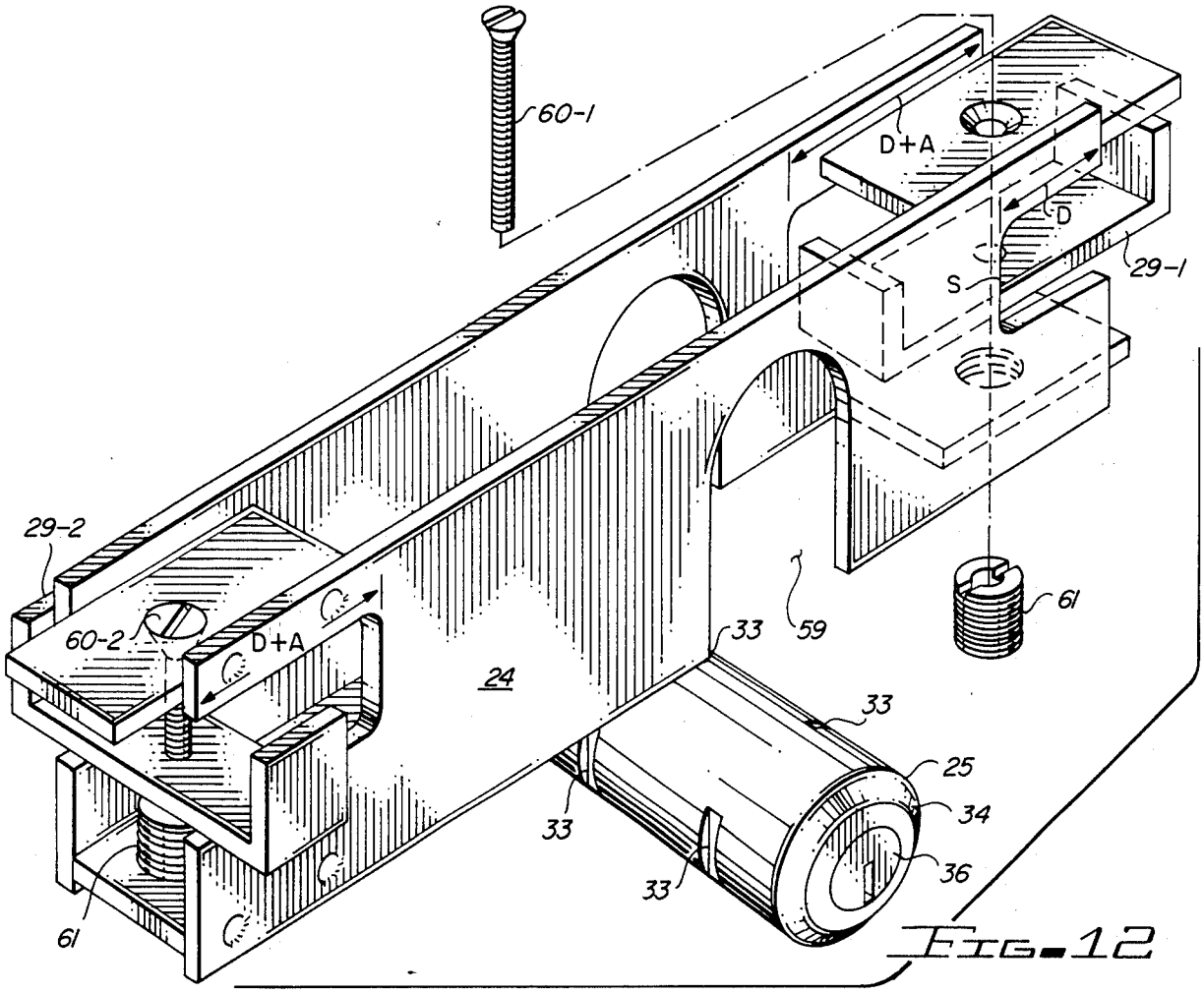
FIG. 12 is a perspective assembly of the lock body showing the compressive means by which the lock body is retained with a hollow stile and the manner in which the lock cylinder housing is engaged with the lock body.

An additional element of the assembly of lock 21 into door stile 22 has been included in the drawing of FIG. 9. Lock body 24 has been passed through the opening 23 of stile 22 so as to engage with lock-body-engagement grooves 33 in housing 25. Reference may be made to FIG. 12 which illustrates the relationship of lock housing 25 to lock body 24. Lock body 24 is provided with openings 59, the edges of which opening 59 engage with grooves 33 in lock housing 25 so as to secure lock housing 25 to lock body 24 in a non-rotating manner.

Figure 11:
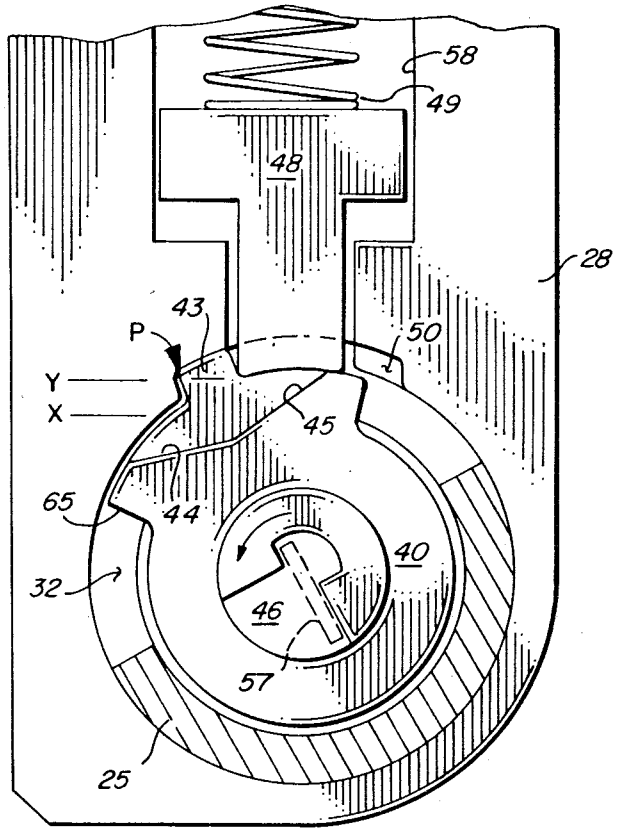
FIG. 11 is similar to that of FIG. 10 but shows the anvil actuator and drive element rotated clockwise to raise the latch bar anvil from its retention port and positioned in engagement with the latch bar in anticipation of rotation of the latch bar about the axis of the lock cylinder housing.
Figure 10:
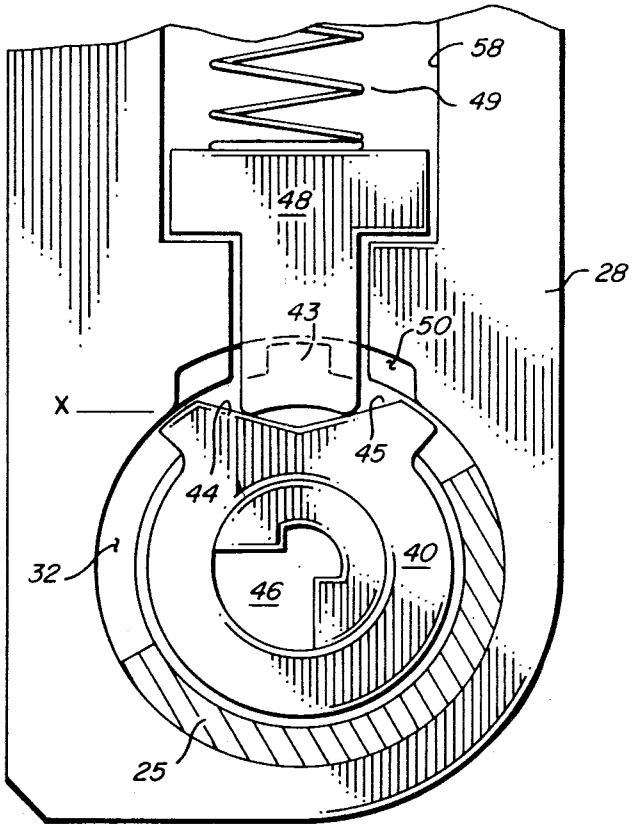
FIG. 10 is an end view of the latch bar and the anvil actuator and drive element taken along section line 10—10 in FIG. 9 showing the latch bar anvil depressed within a retention port of the lock cylinder housing.

The manner in which actuator 40 acts to raise anvil 48 from the retention port 31 in housing 25 and to drive latch bar 28 about housing 25 is illustrated in the views of Fig. 10 and 11 taken along the line 10—10 of FIG. 9. When latch bar 28 is positioned as shown in FIG. 9 anvil 48 extends downward into retention port 31 and partially extending into slot 32, both of housing 25. In this position the base of anvil 48 rests on inclined planes 44 and 45 of actuator 40 as illustrated in FIG. 10. Spring 49 provides a compressive load directing anvil 48 toward the axis of housing cylinder 25 so as to maintain anvil 48 entrapped within retention port 31. With anvil 48 so engaged with retention port 31, latch bar 28 is restrained from rotating about housing 25.

Referring now to FIG. 11 the effect of inserting a key 57, shown in phantom outline, in impeded keyway 46, and rotation of that key in a clockwise direction is shown. As actuator 40 rotates in a clockwise manner, driven by key 57, anvil 48 is elevated as it is drawn upwards along inclined plane 44. When tang 43 of actuator 40 has been rotated to make interfering contact at point P, anvil 48 will have risen above the surface of housing 25. Continued rotation of actuator 40 by key 57 will cause tang 43 bearing against point P to drive latch bar 28 about the axis of housing 25. Latch bar 28 will continue to rotate about the axis of housing 25 under the urging of the tang 43 of actuator 40 until stop 65 on actuator 40 reaches the limit of slot 32 in housing 25.

Removal of key 57 from impeded keyway 46 will return tang 43 so as to be centrally located within arcuate notch 50 of latch bar 28 and again permit anvil 48 to be engaged within a retention port 31 at a position removed 90° clockwise from that illustrated in FIG. 11. In this position of latch bar 28, the latch bar is extended fully from the lock body and the stile of the door. This is the nominal locking position. Upon insertion of key 57 and rotation of key 57 in a counter-clockwise direction, the reverse action takes place; the anvil is raised by inclined plane 45, and tang 43 drives the latch back to the unlocked position illustrated in FIG. 11.

Action of the inclined planes 44 and 45 of actuator 40 is to raise the base of anvil 48 from a base line X, FIG. 10, to a base line Y, FIG. 11. When the base of anvil 48 is raised to base line Y, it has been disengaged from the retention port 31 of housing 25 and may then be driven about the axis of housing 25. Engagement of anvil 48 within either one of retention ports 31 locks latch bar 28 so that it may not be rotated about the axis of housing 25.

The manner in which lock cylinder housing 25 is installed within door stile 22 (FIG. 8) provides a basically strong structural assembly. That structural assembly is further enhanced by the addition of body 24 with its engagement of grooves 33 in housing 25 to prevent rotation of housing 25 about its axis (FIG. 9). To further increase the overall strength of that structural assembly and provide a superior locking device, means for compressively engaging lock body 24 within the interior of stile 22 are provided.

In a presently preferred embodiment of the invention, the means for compressively engaging body 24 within stile 22 is provided by U-shaped compression saddles 29. Two of these compression saddles are illustrated in FIG. 12 as well as their method of coupling to lock boddy 24. A screw fastener 60 is passed through a clearance opening in lock body 24 and threadedly engaged with compression saddle 29.

Attention is called to the right side of FIG. 12. Assume a threaded fastener 60-1 has been installed and threadedly coupled to compression saddle 29-1. At that end of lock body 24 two openings are provided. The opening in the far wall has a length D+A. The opening on the near wall of lock body 24 is foreshortened to a dimension D. Dimension D+A is chosen to permit compression saddle 29-1 to pass freely through the opening of length D+A when rotated about the axis of screw fastener 60-1. However, the foreshortened opening of length D is of insufficient length to permit full rotation of compression saddle 29-1 about the axis of fastener 60. The foreshortened opening of length D provides a stopping abutment S which limits the rotation of compression saddle 29-1 about the axis of fastener 60-1 to approximately a quadrant of a circle.

If compression saddles 29-1 and 29-2 are both aligned in the manner indicated by saddle 29-1, lock body 24 will pass freely through opening 23 in stile 22 so that it may engage with grooves 33 in lock cylinder housing 25. Once lock body 24 has been so emplaced within stile 22, rotation of screw fastener 60-1 will, because of friction in the thread coupling between the screw fastener 60-1 and compression saddle 29-1, cause compression saddle 29-1 to rotate about the axis of fastener 60-1 until it is brought up against the abutment stop S provided by the foreshortening of the opening of D length. At this time, compression saddle 29-1 will have assumed the position shown for compression saddle 29-2. Continued rotation of screw fastener 60-1 will cause compression saddle 29-1 to rise upward of the illustration of FIG. 12 along the axis of fastener 60-1, no further rotation of saddle 29-1 being possible because of its abutting contact with stop S. The operation of screw fastener 60-2 will have a similar affect on the motion of compression saddle 29-2.

When screw fasteners 60 are rotated in a counter clockwise direction compression saddles 29 will travel downward along the axis of screw fastener 60, as illustrated in FIG. 12, until they are free once more to rotate about the axis of fasteners 60 and enter into the openings of length D+A when they are again brought into interfering contact with the stopping abutment S provided by the foreshortening of the opening of length D. In this position both compression saddles 29-1 and 29-2 will be aligned along the longitudinal axis of lock body 24 in the position illustrated for compression saddle 29-1 in FIG. 12. In this position the lock body may be removed from stile 22.

The manner in which compression saddles 29 act to compressively engage lock body 24 within the interior of stile 22 is illustrated in FIGS. 13 and 14. In FIG. 13 the lock body has a dimension determined by the depth of stile 22. Screw fastener 60 has been rotated in a normal right-handed screw manner so as to draw compression saddle transverse to lock body 24. Continued rotation of screw fastener 60 has caused compression saddle 29 to traverse the axis of screw fastener 60 so as to come into contact within interior wall 63 of stile 22 at the point indicated by the letter C. Continued rotation of screw fastener 60 will cause the head of screw fastener 60 to drive lock body 24 into compressive contact with the interior wall 62 of stile 22.

Once contact has been made at points C on both the interior wall 62 and 63 of stile 22 one or two turns of screw fastener 60 will serve to compressively lock lock body 24 within stile 22. Removal of lock body 24 from stile 22 is achieved by rotating screw fastener 60 in an anti-clockwise direction. Such anti-clockwise rotation of fastener 60 causes compression saddle 29 to traverse upwards of the illlustration of FIG. 13 along the axis of fastener 60 until saddle 29 may again rotate through the opening of length D+A to align it with the long axis of the lock body so that the lock body 24 may be removed from stile 22.

In FIG. 14 an alternative embodiment of lock body 24 is illustrated so that lock body 24 may be adapted for installation within door stiles 22 of various interior dimensions. A screw fastener 61 is thread coupled to lock body 24 and adjusted so that it will make contact against interior wall 62 of stile 22 at the points labeled with the letter C. Actuation of screw fastener 60 to draw compression saddle 29 into compressive contact with interior wall 63 of stile 22 will again compressively engage lock body 24 within stile 22 in the manner set forth in the discussion of Fig. 13.

What has been disclosed is a door stile lock having a rotary latch bar. The rotary latch bar contains a compression loaded anvil within its interior. The latch bar rotates about the lock cylinder housing. The housing is provided with retention ports for engaging the compression loaded anvil at selected positions to inhibit rotation of the latch bar when the anvil is so engaged. Interior of the cylinder housing is an actuator rotatable by the lock key. The actuator raises the anvil from the retention ports and drives the latch bar about the axis of the cylinder housing between nominal locked and unlocked positions of the latch bar. The compression loaded anvil engages the retention ports in the cylinder housing at both the nominal locked and unlocked positions. A lock body engages the cylinder housing in a non-rotating manner. The lock body is then compressively engaged within the door stile. The compression is provided by means of a screw driven U-shaped compression saddle having limited rotation about the driving screw fastener and the ability to translate along the axis of that screw fastener.

Those skilled in the art will readily derive other embodiments of the invention drawn from the teachings herein. To the extent that such alternate embodiments are so drawn, it is intended that they shall fall within the ambit of protection provided by the claims appended hereto.

Having described my invention in the foregoing specification and the accompanying drawings in such a clear and concise manner that those skilled in the art may readily understand and easily practice the invention, that which I claim is:

1. In a lock for mounting in a hollow door-stile, said lock having a lock body engagedly supporting a cylinder and keyway block housing, said housing in turn engaging a latch bar for rotation about said housing, and further including a first lock cylinder and keyway block assembly within said housing; the improvement comprising:

a compression loaded anvil slidingly disposed within said latch bar said anvil being slidingly directed by compression loading toward the axis of said cylinder and keyway block housing when said latch bar is rotatingly engaged about said housing; and retention means formed in the surface of said housing for lockingly engaging said anvil so as to prevent rotation of said latch bar about said housing while said anvil is so lockingly engaged.

2. The improvement of claim 1 further comprising actuator means rotatable about the axis of said housing with said keyway block when a key is inserted within said block to engage said actuator means, said actuator means further comprising:

a first portion within said housing for raising said anvil from said retention means so as to free said latch bar for rotation about said housing.

3. The improvement of claim 2 wherein said actuator means further comprises:

a second portion extending without said housing and engaging with said latch bar for driving said latch bar rotatingly about said housing when said anvil has been so raised from said retention means.

4. The improvement of claim 2 further comprising a second lock cylinder and keyway block assembly within said housing, said actuator means being emplaced within said housing between said first and said second lock cylinder and keyway block assemblies and being rotatable about the axis of said housing when a key is inserted within either keyway block of said first and said second assembly.

5. The improvement of claim 2 further comprising means for engaging said lock body within the interior of a hollow tubular structural member of a door after said lock body has been passed freely to the interior of said structural member through an opening in said member provided for said passage therethrough, said engagement means comprising:

screw actuated compression means screw-threadedly coupled to said lock body for rotation about the axis of a screw actuating said compression means and for translation along said same axis; and stop means coupled to said lock body for selectedly limiting rotation of said screw actuated compression means to at least one of two rotated positions, one position permitting ease of passage of said lock body through said opening in said structural member while said screw actuated compression means is coupled to said lock body, and one position permitting compressive engagement of said compression means with the interior of said structural member as said compression means is screw actuated.

6. The improvement of claim 5 wherein said lock body further comprises surface contact means for bearing against a first interior surface of said structural member when said screw actuated compression means is actuated into compressive contact with a second interior surface of said structural member.

7. The improvement of claim 6 wherein said surface contact means comprise screw adjustable extensions of said lock body adjustable for adapting said lock body for installation within structural members of various interior dimensions.

8. The improvement of claim 5 wherein said screw actuated compression means comprises a U-shaped compression saddle coupled to said lock body by a screw-threaded fastener and rotatable about the axis of said screw-threaded fastener until said compression saddle intercepts said stop means thence being translatable along said axis of said screw-threaded fastener as said fastener is rotated about its axis.

9. The improvement of claim 8 wherein said lock body further comprises surface contact means for bearing against first interior surface of said structural member when the legs of said U-shaped compression saddle are drawn into compressive contact with a second interior surface of said structural member.

10. The improvement of claim 9 wherein said surface contact means comprise screw adjustable extensions of said lock body adjustable for adapting said lock body for installation within structural members of various interior dimensions.

11. The improvement of claim 2 further comprising means for compressively engaging said lock body within a hollow tubular structural member of a door after free passage of said lock body to the interior of said structural member through an opening in said structural member provided for such fee passage therethrough, said compressive engaging means comprising:

a stopping abutment on said lock body and a screw fastener coupled to said lock body adjacent said stopping abutment; and compression means threadedly coupled to said screw fastener and rotatable about the axis of said screw fastener until rotated into interfering contact with said stopping abutment and thence translatable along the axis of said screw fastener as said screw fastener is rotated about its axis.

12. The improvement of claim 11 wherein said lock body further comprises surface contact means for bearing against a first interior surface of a hollow structural door member into which said lock body is emplaced, when said screw fastener is rotated about its axis so as to translate said compression means along the axis of said screw fastener and into compressive contact with a second interior surface of the structural member in which said lock is emplaced.

13. The improvement of claim 12 wherein said surface contact means comprise screw adjustable extensions of said lock body adjustable for adapting said lock body for emplacement within structural members of various interior dimensions.

14. The improvement of claim 11 wherein said compression means comprises a U-shaped saddle having two legs which by actuation of said screw fastener are drawn into compressive contact with a first interior surface of a hollow structural door member in which said lock body is emplaced.

15. The improvement of claim 14 wherein said lock body further comprises surface contact means for bearing against a second interior surface of a hollow structural door member when said legs of said U-shaped saddle are drawn into compressive contact with a first interior surface of the same hollow structural door member.

16. The improvement of claim 15 wherein said surface contact means comprises screw adjustable extensions of said lock body for adjustably adapting said lock body for emplacement within hollow structural door members of various interior dimensions.

17. A door lock comprising:

a lock cylinder housing;

an assembly comprising a lock cylinder and a keyway block within said housing;

a latch bar actuator within said housing coupled for rotation with said keyway block about the axis of said housing when a key is inserted into said keyway;

a latch bar rotatingly coupled to said housing and further drivingly coupled to said latch bar actuator for rotation about said housing when said actuator is so rotated;

a compression loaded anvil housed within said latch bar and compressively driven toward the axis of said housing;

retention means on said housing for lockingly engaging said anvil to prevent rotation of said latch bar about said housing; and an anvil actuator coupled to said latch bar actuator for raising said anvil from engagement with said retention means to permit said latch bar to be driven about said housing by said latch bar actuator when a key is inserted in said keyway.

18. The door lock of claim 17 further comprising a lock body non-rotatingly coupled to said housing.

19. The door lock of claim 18 further comprising compression means coupled to said lock body for compressively engaging said lock body within a hollow stile of a door in which said lock is to be mounted, said compression means obviating the use of screw fasteners directly coupling the lock body to said hollow stile.

* * * * *